US006572733B1

(12) United States Patent
Banerjee

(10) Patent No.: US 6,572,733 B1
(45) Date of Patent: Jun. 3, 2003

(54) SYSTEM AND METHOD FOR ALTERING CHARACTERISTICS OF MATERIALS USING AN ELECTROHYDRAULIC DISCHARGE

(75) Inventor: Sujit Banerjee, Marietta, GA (US)

(73) Assignee: Institute of Paper Science And Technology, Inc., Atlanta, GA (US)

( * ) Notice: Subject to any disclaimer, the term of this patent is extended or adjusted under 35 U.S.C. 154(b) by 0 days.

(21) Appl. No.: 09/964,101

(22) Filed: Sep. 26, 2001

Related U.S. Application Data

(63) Continuation-in-part of application No. 09/568,361, filed on May 10, 2000, now Pat. No. 6,521,134.

(60) Provisional application No. 60/295,126, filed on Jun. 1, 2001, and provisional application No. 60/134,284, filed on May 14, 1999.

(51) Int. Cl.[7] ..... D21D 1/64; D21F 1/32; D21F 7/06

(52) U.S. Cl. ..... 162/50; 162/199; 162/263; 162/DIG. 4; 162/192; 427/580; 427/457; 204/164; 204/450; 204/554

(58) Field of Search ..... 427/580, 444, 427/487; 162/199, 263, DIG. 4, 192, 50; 204/164, 450, 554

(56) References Cited

U.S. PATENT DOCUMENTS 4,479,680 A 10/1984 Wesley et al. ..... 299/14

5,961,803 A * 10/1999 Landfors et al. ..... 204/529

OTHER PUBLICATIONS

D. Willberg et al., "Electrohydraulic Cavitation and Sonolysis," *Environmental Applications of Advanced Oxidation Technologies*, Sep. 1997, EPRI Report CR–107581, pp. 7.1–7.12.

A. Coleman et al., "Acoustic Cavitation Generated by an Extracorporeal Shockwave Lithotripter," *Ultrasound in Medicine and Biology*, 1987, vol. 13, pp. 69–76.

S. Abraham, "Successful Approach in Avoiding Stickies," *Tappi J.*, 1988, vol. 81:2, pp. 79–84.

J. Robinson et al., "Ultraviolet Radiation From Electrical Discharges in Water," *J. Appl. Phys.*, 1973, vol. 44, p. 72–75.

* cited by examiner

*Primary Examiner*—Steven P. Griffin
*Assistant Examiner*—M. Halpern
(74) *Attorney, Agent, or Firm*—Veda V. Christmas, Esq.

(57) ABSTRACT

System and method for oxidizing contaminants to alter specific properties, such as tack, of contaminants. The present invention reduces the tack of the stickies and pitch by exposing the materials for a short duration to low-energy pulsed electrical discharges between a pair of electrodes that are submerged in a liquid medium, such as a fiber stream, water, a pulp slurry, or whitewater. An electrical discharge in the liquid medium oxidizes materials, which may be dissolved or suspended therein, such as stickies, pitch, sulfide, ink, toner, and other substances, thereby reducing tack, odor, and/or zeta potential, as well as producing other desirable effect.

39 Claims, 13 Drawing Sheets

SYSTEM AND METHOD FOR ALTERING CHARACTERISTICS OF MATERIALS USING AN ELECTROHYDRAULIC DISCHARGE

CROSS REFERENCE TO RELATED APPLICATIONS

This is a continuation-in-part application of Ser. No. 09/568,361, now U.S. Pat. No. 6,521,134 filed May 10, 2000 claiming the benefit of U.S. Provisional Application Serial No. 60/134284, filed May 14, 1999, and claiming the benefit of U.S. Non-provisional Application Serial No. 60/295126, filed Jun. 1, 2001, all of which are incorporated herein by reference.

GOVERNMENT INTEREST

This invention was made with Government support under Contract No. DE-FC36-996010381, awarded by the Department of Energy. The Government has certain rights in this Invention.

FIELD OF THE INVENTION

The present invention generally relates to the art of controlling specific characteristics of materials, and more particularly pertains to oxidizing and/or altering the tack of contaminants found in an aqueous stream, such as water, whitewater, and pulp slurries.

BACKGROUND OF THE INVENTION

People throughout our society have become increasingly aware and concerned about the environmental issues that plague the world. The depletion of the ozone layer, the rain forests, and clean water are just a few of the environmental issues that are being addressed. One approach in addressing these issues includes preserving resources by recycling them. Consequently, the recycling industry has become instrumental to serving this need.

In the recycling field, one area of increasing interest is the reuse of wastepaper. Millions of tons of wastepaper are generated every year in the United States. Recycling this wastepaper can save countless trees, as well as provide other ecological and economic benefits. However, the key to reuse of this wastepaper is the removal of contaminants from the wastepaper, thereby facilitating the use of recycled or secondary fibers from the wastepaper.

The paper recycling industry encounters a variety of contaminants in wastepaper. Many of these contaminants adhere to paper fibers and therefore may cause problems during the recycling process. One such contaminant is "stickies", which were used originally as paper adhesives or tacky adhesives. Stickies typically are classified as hot melts, pressure-sensitive adhesives (PSAs), latexes, and binders. Pitch is another contaminant associated with both virgin and secondary fibers. Pitch is a part of the extractives from wood, and is released during pulping. Other contaminants include ink, toners, sulfides, iron, and any other substance that may be found in water, and particularly a fibrous stream.

Contaminants may cause operational arid product quality problems. Specifically, contaminants may be deposited on wires, felts, press rolls, and drying cylinders of paper machines. In addition, contaminants may hinder bonding of fibers, increase web breaks, and reduce product quality in the papermaking process. Consequently, contaminants must be controlled in order to improve papermaking operations and product quality.

Tack is the sticky property of paper adhesives, paperboard adhesives and glue coating materials. The tack of an adhesive and the adhesive's ability to bond to another surface is dependent, in part, upon the surface energy of the adhesive. Reducing the tack of contaminants can minimize the propensity of the contaminants to attach to paper machine surfaces, thereby leading to fewer operational problems.

Various prior art methods are used to reduce the tack of the contaminants. Some methods use repulpable or recyclable adhesives. More common methods include chemical additives for modification, detackification, or pacification of the contaminants. For instance, detackification of contaminants is frequently accomplished by adding minerals, such as talc, or surface-active chemicals. These minerals and surface-active chemicals attach to the surface of the contaminants and alter their surface properties, thereby causing tack reduction. This method of tack reduction is described in a publication entitled, "Successful Approach in Avoiding Stickies," by S. Abraham, Tappi J., 81:2 79–84 (1998), which is incorporated herein by reference. Nonetheless, chemical additives can be very expensive and may cause other problems in the papermaking process, such as a decline in product quality.

Mechanical methods for controlling contaminants include dispersion, screening and cleaning. Dispersion is a technique by which contaminants are broken up into smaller and smaller particles until they are invisible in the final product. Unfortunately, the overall appearance of a product may be diminished greatly by the presence of contaminants. In addition, when the product containing contaminants is wound, sticking may occur between adjacent layers.

Screens and centrifugal cleaners are typically used to remove stickies, pitch and debris from the fiber stream. In general, screens are used to physically separate fiber from contaminants based on the differences between the sizes and shapes of contaminants and the holes or slots in the screen. One problem is that screens cannot remove contaminants that are either smaller than the size of the screen hole or deformable enough to pass through the screen hole. Centrifugal cleaners separate contaminants from fiber primarily on differences between the specific gravities of the fiber and the contaminant. However, separation is poor if the specific gravity of the contaminant is similar to the specific gravity of the fiber.

In an article by Lang et al., a photolytic process is used to oxidize trinitrotoluene. P. S Lang, W-K Ching, D. M. Willberg, M. R. Hoffman, "Oxidative Degradation of 2,4, 6-trinitrotoluene by Ozone in an Electrohydraulic Discharge Reactor," Environ, Sci. Technol., 32, 3142–3148 (1998). Specifically, trinitrotoluene is dissolved in water in a 4-liter reactor and oxidized as a result of light emitted from an electrical discharge. Similarly, in an article by Willberg et al., a photolytic process is used to oxidize 4-chlorophenol (4-CP). Specifically, 4-CP is dissolved in water in a 4-liter reactor and oxidized as a result of light emitted from an electrical discharge. D. M. Willberg, P. S Lang, R. H. Hochemer, A. Kratel, M. R. Hoffman, "Degradation of 4-chlorophenol, 3,4-dichloroaniline and 2,4,6-dinitrotoluene in an Electrohydraulic Discharge Reactor," Environ, Sci. Technol., 30, 2526–534 (1996). The distance of the sides of the vessel from the source is estimated to be 8 cm. Lang et al. and Willberg et al. both discuss that the oxidation process occurs in the plasma channel between and in the immediate vicinity of the electrodes, and as a result of a photolytic process induced by light emitted from a discharge between the electrodes.

Therefore, there is a need for a system and method for improving the removal efficiency of contaminants, such as stickies and pitch, from a fiber stream. In addition, there is a need for a system and method that can oxidize and/or detackify contaminants by altering, without the use of chemicals, the surface properties of the contaminants. Also, there is a need for a system and method for oxidizing materials at great distances for applicability in large-scale industrial settings. There is yet another need for a system and method that can alter the surface properties of materials inexpensively and simply.

SUMMARY OF THE INVENTION

The present invention solves the above-described needs by providing a system and method for oxidizing a material by exposing the material to an electrical discharge in a liquid medium.

One method for oxidizing a material in a fiber stream comprises the steps of providing a fiber stream; and causing oxidation of a material in the fiber stream by producing a predetermined amount of electrical discharge in the fiber stream. The material in the fiber stream is oxidized such that the zeta potential of the material in the fiber stream is reduced and/or the tack of the material is reduced.

The material can be ink or toner, where the ink or toner is oxidized such that the ink's or toner's ability to adhere to a fiber in the fiber stream is reduced. The material can be a sulfide, where the sulfide is oxidized such that the odor of the fiber stream is reduced. The material can be a polymer used as an adhesive, such as stickies, or it can be pitch, where the polymer or pitch is oxidized such that the tack is reduced.

Another method for oxidizing a material in a liquid medium comprises the steps of providing a liquid medium; providing a material in the liquid medium; and introducing a predetermined amount of electrical discharge in the liquid medium to cause oxidation of the material, said oxidation occurring independent of a light source. The electrical discharge in the liquid medium can occur periodically.

The liquid medium is selected from a group consisting whitewater, water, and a pulp slurry. The material is oxidized such that the zeta potential and/or tack of the material is reduced or the odor of the liquid medium is reduced depending on the material that is oxidized.

An alternative method for oxidizing a material in a liquid medium, comprises the steps of providing a liquid medium containing a material; and introducing a predetermined amount of electrical discharge from a discharge source in the liquid medium to cause oxidation of the material at a predetermined distance in the liquid medium from the discharge source, where light emitted from the discharge source is negligible. The predetermined distance can occur beyond 8 cm from the discharge source and typically, may be at a distance ranging from about 10 cm to about 4.5 m from the discharge source.

These and other objects, features, and advantages of the present invention may be more clearly understood and appreciated from a review of the following detailed description of the disclosed embodiments and by reference to the appended drawings and claims.

BRIEF DESCRIPTION OF THE DRAWINGS

FIG. 3 illustrates another exemplary operating environment consistent with an embodiment of the present invention.

DETAILED DESCRIPTION

Polymers used as adhesives, such as stickies, and pitch are commonly found in white water and pulp slurries. Consequently, these contaminants due to their sticky property, known as tack, can attach to components of a paper machine, thereby causing operational problems. Other contaminants that may be found in whitewater and pulp slurries include ink, toner, sulfides, and so forth. Any one of these contaminants, including stickies and pitch, can reduce product quality when present in a final product produced by the paper machine. Hence, it is desirable to reduce the tack of these materials in the whitewater or pulp slurry to ameliorate the removal of these contaminants from the fiber stream, to eliminate the negative effects they have on product quality when present in the final product, and to reduce operational problems. By doing so, the whitewater or pulp slurry can be efficiently used in the papermaking process.

In general, the present invention provides a system and method for altering the surface properties, such as tack, of a material through oxidation, which in turn, improves the removal efficiency of the materials or contaminants from a liquid medium, diminishes the negative effects of tackiness the contaminants may have on the final product, and reduces papermaking operational problems. It has been found by those skilled in the art that a material becomes less tacky by changing the surface energy of the material.

While prior art methods use techniques for altering the tackiness of materials by using chemical additives, the present invention does not require chemicals for this purpose. Specifically, the present invention changes the surface energy of a material by exposing the material for a short duration to low-energy pulsed electrical discharges between a pair of electrode's that are submerged in a liquid medium. The result is a detackified or less tacky material, which improves removability of the contaminant from a liquid medium, such as a fiber stream, and reduces papermaking operational and process problems.

As used herein, the terms "material" and "contaminant" are used interchangeably and refer to polymers, pitch, ink, toner, sulfides, iron, and any other substances that may be found in water or a fiber stream.

Exemplary embodiments of the present invention are described herein below in connection with FIGS. 1–14, wherein like numerals represent like elements among the figures, and the accompanying examples.

Figure 1:
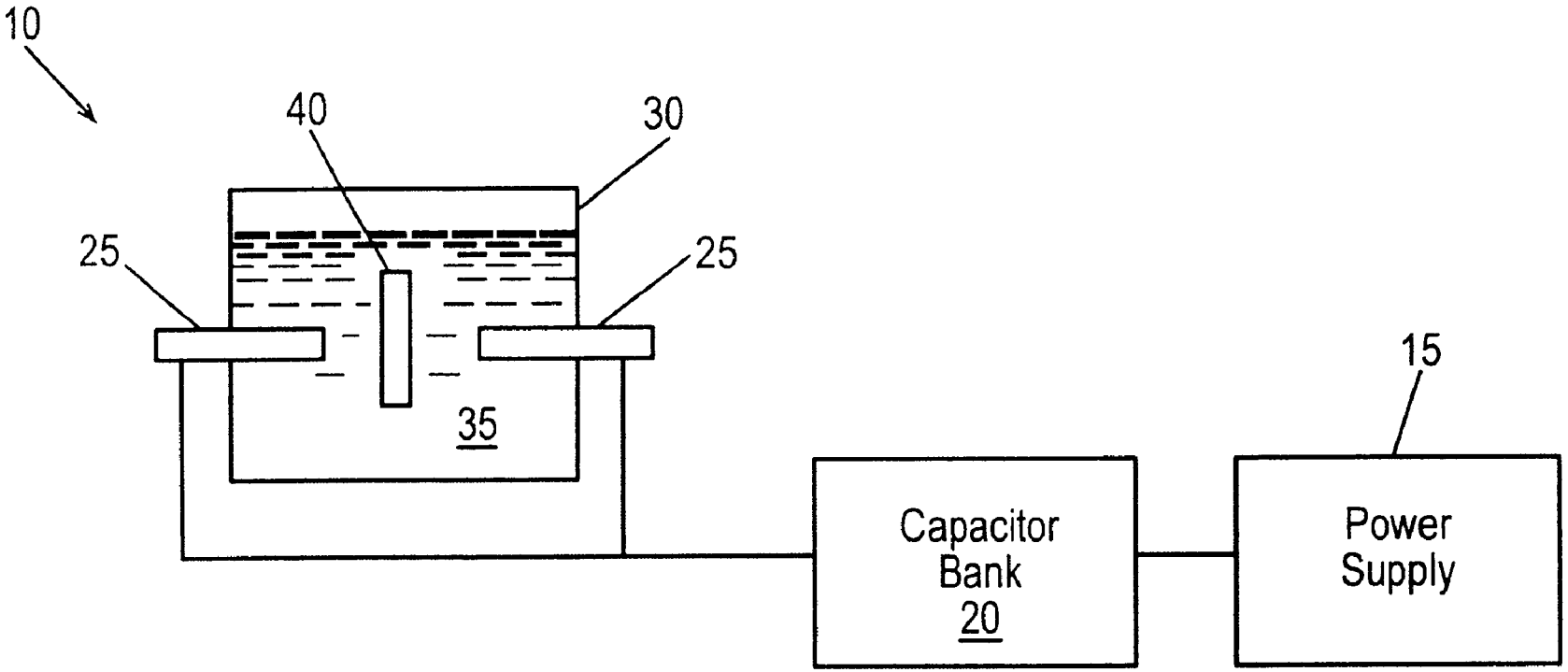
FIG. 1 illustrates a system for reducing the tackiness of a material consistent with an embodiment of the present invention.

Referring to FIG. 1, a system for oxidizing and/or reducing the tackiness of a material consistent with an embodiment of the present invention is shown. The system 10 includes a chamber 30 for housing a liquid medium, and a sparking device, comprising a power supply 15, a capacitor bank 20, and a pair of electrodes or sparker 25. A sparking device that can be used in the present invention is the Sparktec plasma sparker (SPK-8000), which is manufactured and sold by Sparktec Environmental of Stoney Creek, Ontario, Canada.

Specifically, the pair of submersible electrodes or sparker 25 is cabled to a bank of capacitors housed in the capacitor bank 20. The sparker 25 releases the energy stored by the capacitors and may be placed in the chamber 30 containing a liquid medium 35. Alternatively, the sparker 25 may be positioned in a tank or other container, as shown in connection with FIG. 2, or in pipes through which the liquid medium flows, as shown in connection with FIG. 3. The sparker 25 may include a feeding mechanism (not shown), which ensures that the gap between the-electrodes remains constant.

The power supply 15 controls power management and is functionally connected to the capacitor bank 20 for providing a constant current power supply to the capacitor bank 20. The power supply 15 may include a computer interface, which monitors the supply unit, controls the electrode feed mechanism, if present, and times the high voltage/high current discharge pulse generated by the bank of capacitors.

The capacitor bank 20 contains a bank of high voltage discharge capacitors for storing-energy. The capacitor bank 20 may include a switch mechanism (not shown), which triggers the release of a high voltage/high current pulse to the sparker 25.

It will be appreciated by those skilled in the art that the present invention may include any suitable power supply capable of controlling power management and converting AC current to high DC voltages. It is further appreciated that the present invention may utilize any pair of electrodes suitable for releasing high voltage/high current energy and capable of being properly secured such that the gap between the electrodes remains constant. For example, a pair of electrodes may be securely clamped or welded to a chamber or an air compressor may be used to ensure that the gap between the electrodes remains constant.

Referring to FIG. 1, the system 10 operates by injecting energy into a liquid medium 35 through a plasma channel formed by a high-current/high-voltage electrical discharge between the two submersed electrodes 25. The system 10 works on the same principle as a spark plug.

Specifically, a high voltage and a high current are impressed between the pair of electrodes 25, also referred to herein as a sparker 25, for a very short duration such that the energy dissipates by sonic/ultrasonic waves (also referred to as shock waves) that break up the water molecules. Consequently, the water molecules closest to the spark break up due in part to the spark itself, while the water molecules at some distance from the spark break up due to the sound waves caused by the spark. The electrohydraulic discharge or spark also produces ultraviolet and other radiation and generates reactive chemical species, such as hydroxyl radicals and other oxidants. This effect is described in greater detail herein below in connection with FIGS. 8–14. As used herein, the terms "electrical discharge" and "electrohydraulic discharge" are used interchangeably, where electrohydraulic discharge means an electrical discharge that takes place in a liquid medium.

In the present invention, the high voltage used is preferably in the range of 500 V to 20,000 V, and more preferably in the range of 2,000 V to 8,000 V. The high current used is preferably in a range of 10,000 A to 100,000 A, and even more preferably about 50,000 A. The duration of the electrical discharge is preferably less than 1 second, and more preferably in the range of 5 microseconds to 500 microseconds, and even more preferably about 150 microseconds.

When the sparker 25 is activated by supplying power from the power supply 15 to the capacitors in the capacitor bank 20, the capacitors are rapidly charged with electricity. At a predetermined interval, a process controlled high voltage/high current switch (not shown) associated with the capacitor bank 20 releases the stored energy from the capacitors to the electrodes 25 located in the chamber 30 containing the liquid medium 35. The high voltage/high current released from the capacitors then bridges the gap at the electrodes 25 causing the spark. Each spark preferably has energies ranging from 0.1 kJ to 25 kJ, and more preferably about 12 kJ.

With continuing reference to FIG. 1, the material 40 to be treated is placed in the liquid medium 35 surrounding the sparker 25, and the sparking device is activated, whereupon the surface energy of the material is altered by the effect of the spark transmitted through the liquid medium 35. In other words, the material 40 is exposed to the electrical discharge from the electrodes 25.

The exposure may be direct, where the contaminant is or almost is in direct contact with the electrical discharge of the sparker 25 due to the close proximity of the contaminant to the sparker 25. Alternatively, the exposure may be indirect since the surface energy of the contaminant can be affected through oxidation at a distance from the spark.

After exposure to the electrical discharge, the material's surface energy changes, thereby altering certain characteristics, such as the tack, of the material. Typically, the surface energy of the material increases after exposure to the electrical discharge. The material is exposed to at least one spark, but can be exposed to multiple sparks. Those skilled in the art will understand that the surface energy of the material may either increase or decrease after exposure to the electrical discharge resulting in an alteration in the tack property and other properties of the material.

The liquid medium can be whitewater, a pulp slurry, or other fiber stream, where paper fibers are suspended in the stream and are transported with the flow of the stream. The liquid medium may also be water, which may or may not contain a solution of chemicals, such as chlorite or sodium hypochlorite, or chemicals typically present in whitewater.

The material to be treated is preferably a polymer used as an adhesive, also known as "stickies". As previously described, stickies may be classified as hot melts, latexes, pressure sensitive adhesives (PSAs), and binders. Examples of stickies include, but are not limited to polyacrylate PSAs, polyvinyl acetate (PVAc) and polyurethane. The group of polymers used as adhesives is commonly known by those skilled in the art, and the present invention is not limited in any way as to its applicability to altering the tack of that group of polymers used as adhesives. In addition, the material to be treated may also be pitch, which is a natural component of wood that behaves like stickies and is found in virgin fiber, as well as secondary fiber. These materials, namely stickies and pitch, are oftentimes attached to the surface of an object, such as paper machine components, including felts, wires, press rolls, drying cylinders, and other surfaces of the paper machine. Furthermore, the material to be treated can be ink, toners, irons, sulfides, and other substances that can be dissolved or suspended in the liquid medium. These materials, including stickies and pitch, may also attach to fibrous surfaces, including paper, paperboard, and the like.

Figure 2:
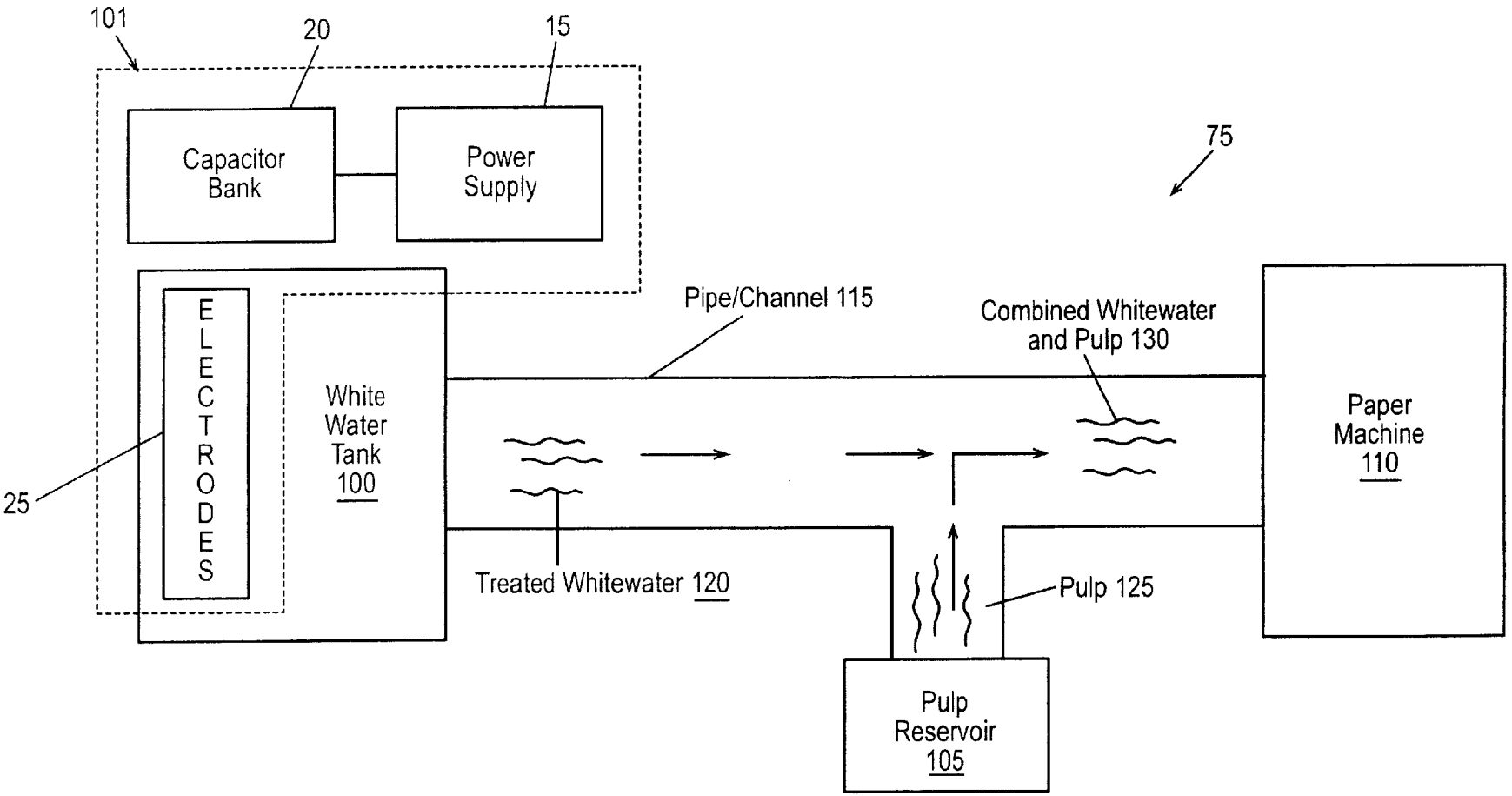
FIG. 2 illustrates an exemplary operating environment consistent with an embodiment of the present invention.
Figure 1:
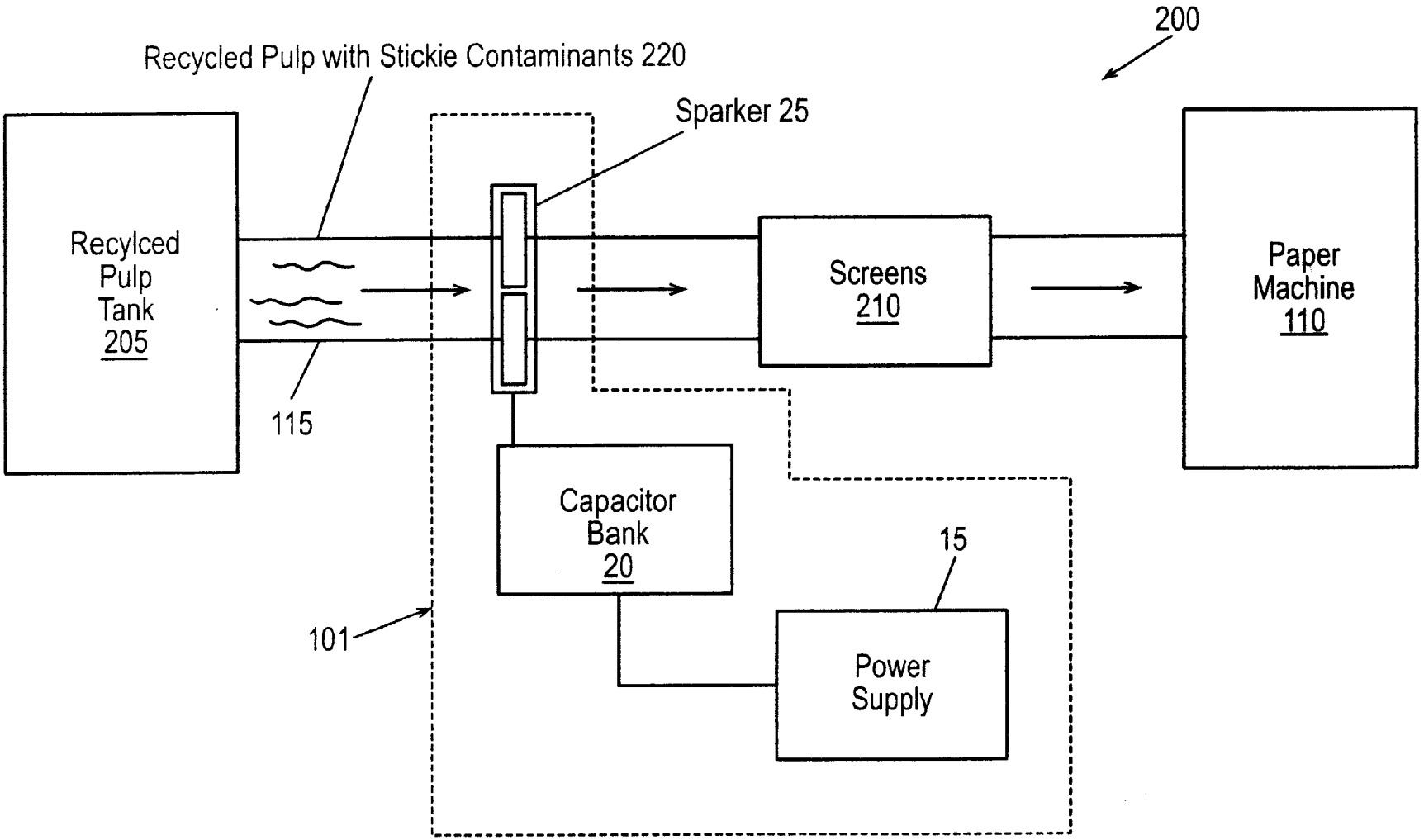

FIGS. 2 and 3 illustrate exemplary operating environments for oxidizing contaminants in whitewater and recycled pulp, respectively. As used herein, the term "recycled pulp" refers to a pulp slurry containing contaminants such as stickies, pitch, ink, and/or other solids, which can be dissolved or suspended in a liquid medium.

In FIG. 2, the operating environment 75 shows a whitewater tank 100, which contains contaminated whitewater, namely whitewater with stickies and/or pitch. In addition, FIG. 2 shows a sparking device 101 comprising a pair of electrodes 25, a capacitor bank 20, and a power supply 15. The sparking device 101 is positioned such that the electrodes 25 are submerged in the whitewater tank 100. In paper mill and recycling environments, the sparker may have dimensions of about 4 feet high, about 5 inches wide, and about 2.5 inches deep, like the sparker manufactured and sold by Sparktec Environmental of Stoney Creek, Ontario, Canada. Those skilled in the art will understand that the present invention is not limited to the aforementioned sparker, but may integrate a sparker meeting specified parameters in the tank.

In FIG. 2, the contaminated whitewater is repeatedly exposed to the electrical discharges of the sparker 25, as previously described in connection with FIG. 1, while in the whitewater tank 100 until it oxidizes to become less tacky, for example. This treated whitewater 120 then flows through the pipe or channel 115 and effectively combines with pulp 125, which flows from a pulp reservoir 105. Next, the combined whitewater and pulp 130 continues its approach flow to the paper machine 110. Advantageously, the present invention reduces operational problems that occur due to contaminants in the papermaking process.

It will be appreciated by one skilled in the art that the sparking device 101 is not limited to placement in the whitewater tank 100, but may be placed anywhere in the system for treatment of the whitewater prior to its approach flow to the paper machine 110.

Referring to FIG. 3, the sparking device 101 is integrated into the pipe or channel 115 in a recycled pulp environment 200. Specifically, the sparking device 101 is positioned and secured between a recycled pulp tank 205 and screens 210. The recycled pulp tank 205 contains recycled pulp 220. As the recycled pulp 220 flows from the recycled pulp tank 205 to the screens 210, the pulp 220 is repeatedly exposed to the electrical discharges of the sparker 25.

As a result of exposure to the electrical discharge or spark, the surface energy of the contaminants in the pulp is altered such that the tack of stickies is reduced in one example or the ability of ink to adhere to fibers is reduced in another example. The treated pulp then flows through the screens 210, which filter out the contaminants, and continues its approach flow to the paper machine. As previously mentioned, this process improves the removal efficiency of contaminants from the fiber stream as is shown in connection with FIGS. 6*a* and 6*b*, which are described in greater detail herein below.

It is preferable that the sparker is positioned as early in the flow process as possible. However, it will be appreciated by one. skilled in the art that the sparker 25 may be positioned anywhere in the system as long as the pulp is treated before the pulp flows to the paper machine 110. Moreover, one skilled in the art will understand that direct exposure or contact with the electrical discharge from the electrodes is unnecessary due to the fact that the surface energy of the material may be altered a distance upstream or downstream from the location of the electrical discharge.

The present invention is not limited to the use of one sparker for the treatment of contaminated whitewater, pulp slurries, or other liquid media. Multiple sparkers may be used to oxidize contaminants. The sparkers may discharge at different times or at the same time. The sparkers may be arranged such that each has its own capacitor bank and power supply. Alternatively, the sparkers may share a common capacitor bank and/or power supply. Also, at least one sparker may be placed directly in a tank containing the whitewater, pulp slurry or other liquid media, instead of or in addition to placing the sparker along the pipe or channel through which the liquid medium containing the contaminants flows. As previously described, the present invention is not limited to uses with whitewater and pulp slurries, but may also include other liquid media containing polymers used as adhesives, pitch, and/or other contaminants that may be dissolved or suspended in the liquid medium.

The following examples, which are merely illustrative of the present invention, further demonstrate applications of the present invention in altering the properties of contaminants, as well as demonstrate the benefits associated therewith.

EXAMPLE 1

Two 316 stainless steel coupons (5.5 $cm^2$) were coated with 10 mL of an acrylate pressure sensitive adhesive (Carbotac latex from B.F.Goodrich), and dried so that the acrylate formed a thin, tacky surface film. One coupon was submerged in water in a thirty-gallon tank and treated with thirty sparks delivered with the sparking device. The surface energy of the film was measured before and after sparking. Surface energy is a measure of tack. Before treatment by the sparker, the surface energy was 15.7 dy/cm, whereas after treatment by the sparker, the surface energy was 22.9 dy/cm. These results demonstrate a substantial increase in surface energy upon spark treatment, where an increase in surface energy of the film indicates a reduction in tack.

EXAMPLE 2

Stainless steel coupons (5.5 $cm^2$) were coated with 10 mL of an acrylate pressure sensitive adhesive (Carbotac latex from B.F.Goodrich), and dried so that the acrylate formed a thin, tacky, surface film. These coupons were submerged in water in a three-gallon tank, and treated with sparks delivered with the sparking device. The results listed in Table 1 demonstrate that sparking induces an increase in surface energy, and that the tack decreases upon sparking. In this instance, tack is defined as the force required to remove a 1" diameter 305 stainless steel probe from the surface of the film as measured by a commercially available instrument manufactured by Instron of Canton, Mass. One measurement was also made where the stickie was applied to a piece of blotting paper prior to sparking. The surface energy of the stickie film was also elevated, indicating that detackification did not require the stickie to have a hard base, but was also effective when it was deposited on fiber.

TABLE 1

Effect of Sparking on the Surface Energy and Tack of an Acrylate Film

| conditions | sparks | Surface energy (dynes/cm) | tack (psi) |
|---|---|---|---|
| control | 0 | 17.4 | 20.6 |
| sparked in water | 10 | 28.8 | 11.7 |
| sparked in water | 30 | 26.7 | 9.03 |
| sparked in water | 60 | 27 | 9.78 |
| sparked in whitewater | 30 | 29.6 | 6.49 |
| sparked in water in the presence of sodium hypochlorite | 30 | 29.6 | 3.45 |

EXAMPLE 3

Experiments were also conducted in the presence of a small amount of sodium hypochlorite (1.4 g/L) dissolved in the water. In the presence of sodium hypochlorite, the surface energy of the stickie increased to an extent greater than the surface energy increase realized with the same number of sparks in the absence of the sodium hypochlorite. An attendant decrease in tack was also realized. It is speculated that one reason for this outcome is the alteration of sodium hypochlorite by the spark, thereby causing it to dissociate into active species, which then interacted with the polymer.

EXAMPLE 4

Experiments were also conducted where the metal coupon was submerged in paper mill whitewater. The surface energy of the stickie increased to an extent greater than the surface energy increase realized with the same number of sparks in the presence of water alone. An attendant decrease in tack also occurred.

Both the sodium hypochlorite and the whitewater experiment demonstrate that components present in or added to water may induce a degree of detackification additional to that anticipated by sparking in water alone.

EXAMPLE 5

Figure 4:
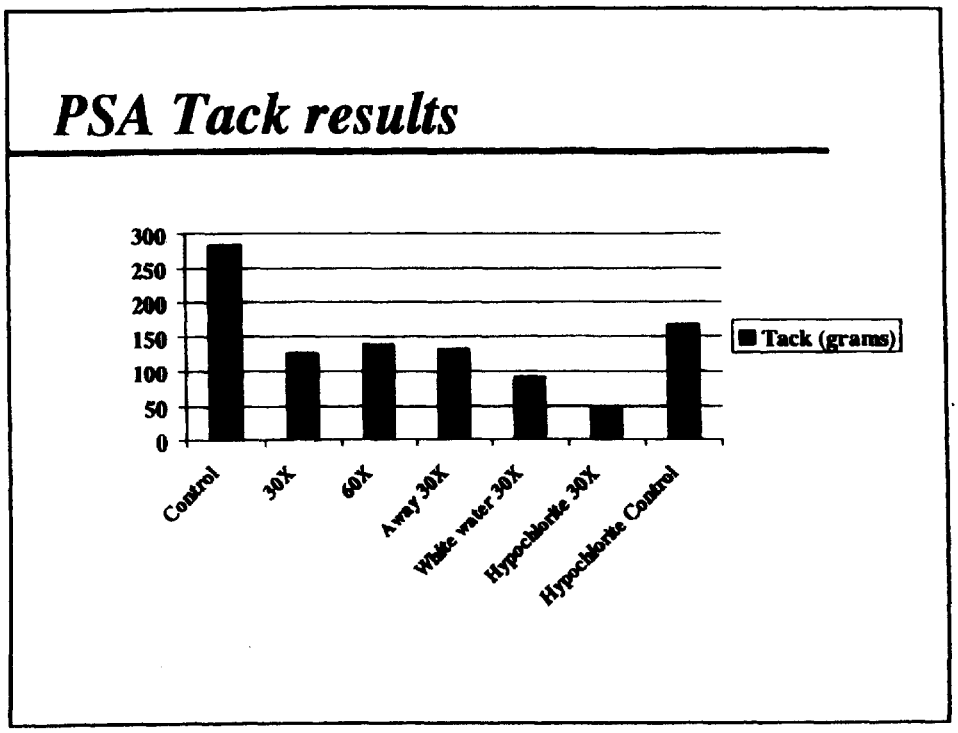
FIG. 4 is a graph illustrating the effects of sparking on tack of stickies under various experimental conditions in accordance with an embodiment of the present invention.

FIG. 4 is a graph illustrating the reductions of tack on PSAs. All PSA samples were polyacrylate films on metal coupons. Samples were sparked in water thirty times, sixty times, both toward the spark, and thirty times turned away from the spark. Each shows similar tack reductions in comparison with a control, which was placed in water, but not sparked. Other samples were sparked thirty times in whitewater from a recycle mill and thirty times in 500-ppm hypochlorite solution in water. Both samples showed decreases in tack compared to the regular water control sample and the hypochlorite control, which was placed in the 500-ppm hypochlorite solution, but not sparked.

EXAMPLE 6

Figure 5:
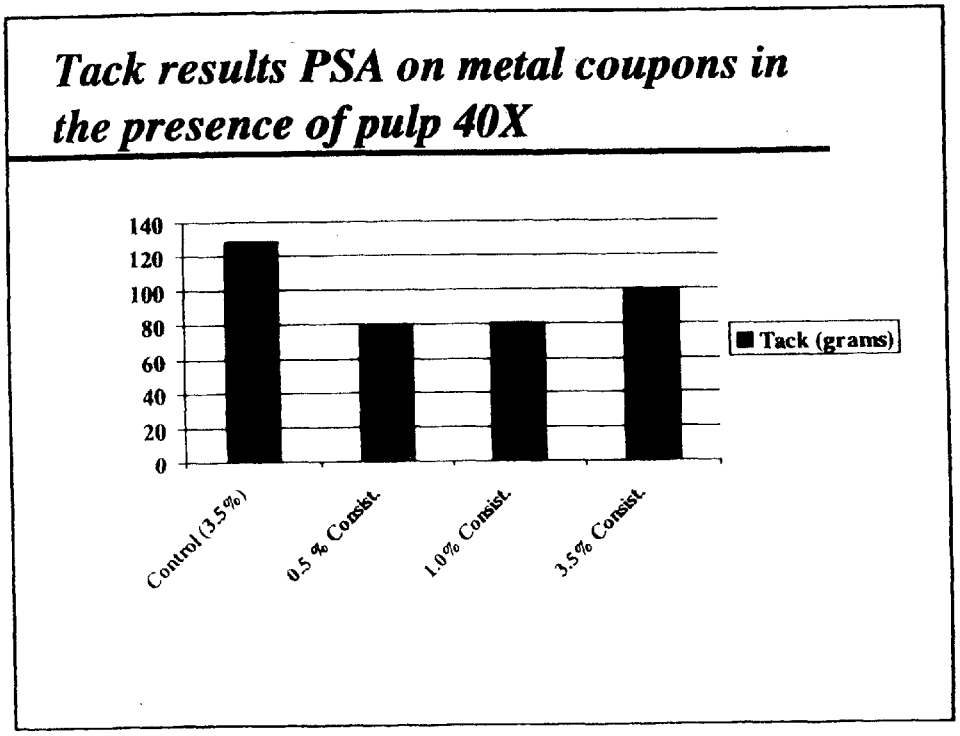
FIG. 5 is a graph illustrating the effects of sparking on tack of stickies under various experimental conditions in accordance with an embodiment of the present invention.

FIG. 5 is a graph illustrating the reductions of tack on PSAs in the presence of bleached Kraft pulp in water at various consistencies. All PSA samples were polyacrylate films on metal coupons. The tack was reduced for PSAs sparked forty times in 0.5, 1.0, and 3.5% consistency pulp (based on fiber/fiber+water) compared to the control which was placed in 3.5% consistency pulp in water, but not sparked.

EXAMPLE 7

Figure 6A:
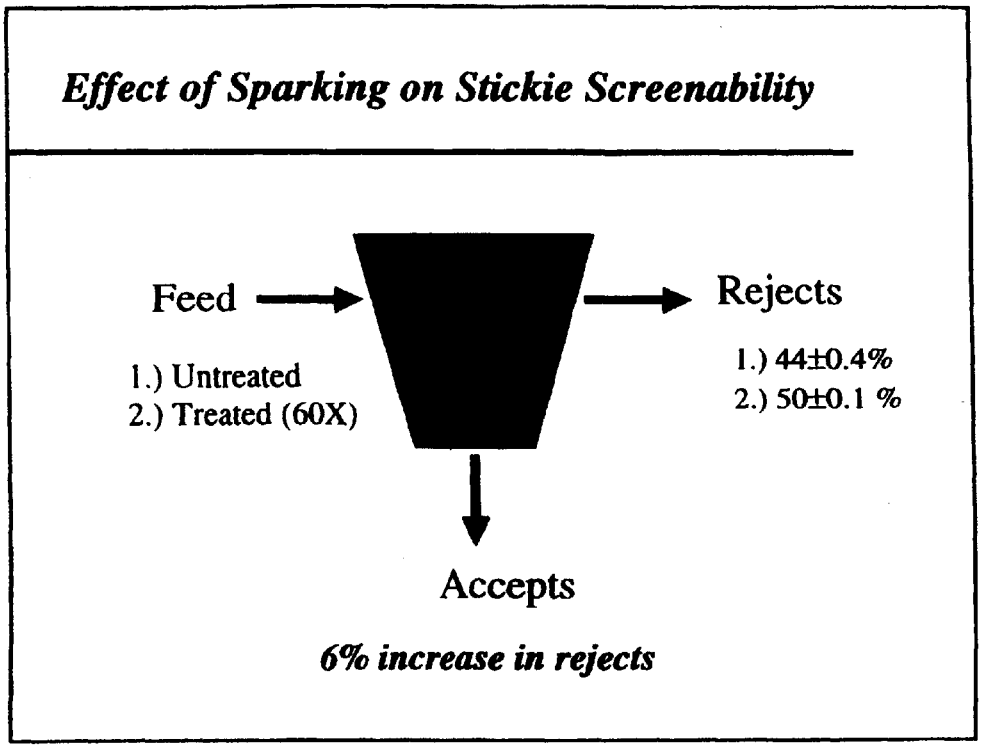
FIGS. 6*a* and 6*b* illustrate the effects of sparking on stickie screenability in accordance with an embodiment of the present invention.
Figure 6B:
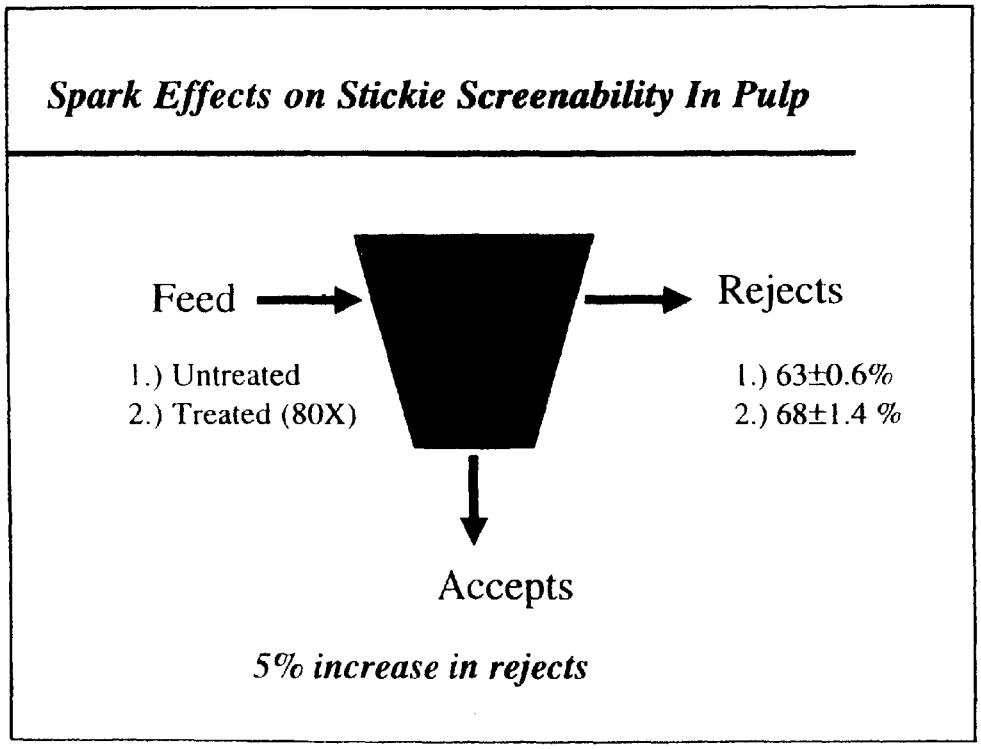

FIGS. 6*a* and 6*b* illustrate the effect of sparking on screenability. PSA in FIG. 6*a* was emulsified in water to a 0.1% consistency (PSA/PSA+water) solution, then the solution was then split into two equal volumes. The reject amount of stickie PSA screened using a 150-micron PULMAC pressure-screening device, which is manufactured and sold by Pulmac of Montpelier, Vt., increased 6% with sixty sparks compared to the control volume, which was screened but not sparked.

PSA in FIG. 6*b* was emulsified in water to a 0.1% consistency (PSA/PSA+water) solution and mixed with bleached Kraft pulp to achieve a 1% pulp consistency. Finally, the stickie-pulp-water solution was then split into two equal volumes. The reject amount of stickie PSA screened using a 150-micron PULMAC pressure-screening device increased 6% with eighty sparks compared to the control volume, which was screened but not sparked.

EXAMPLE 8

Figure 7:
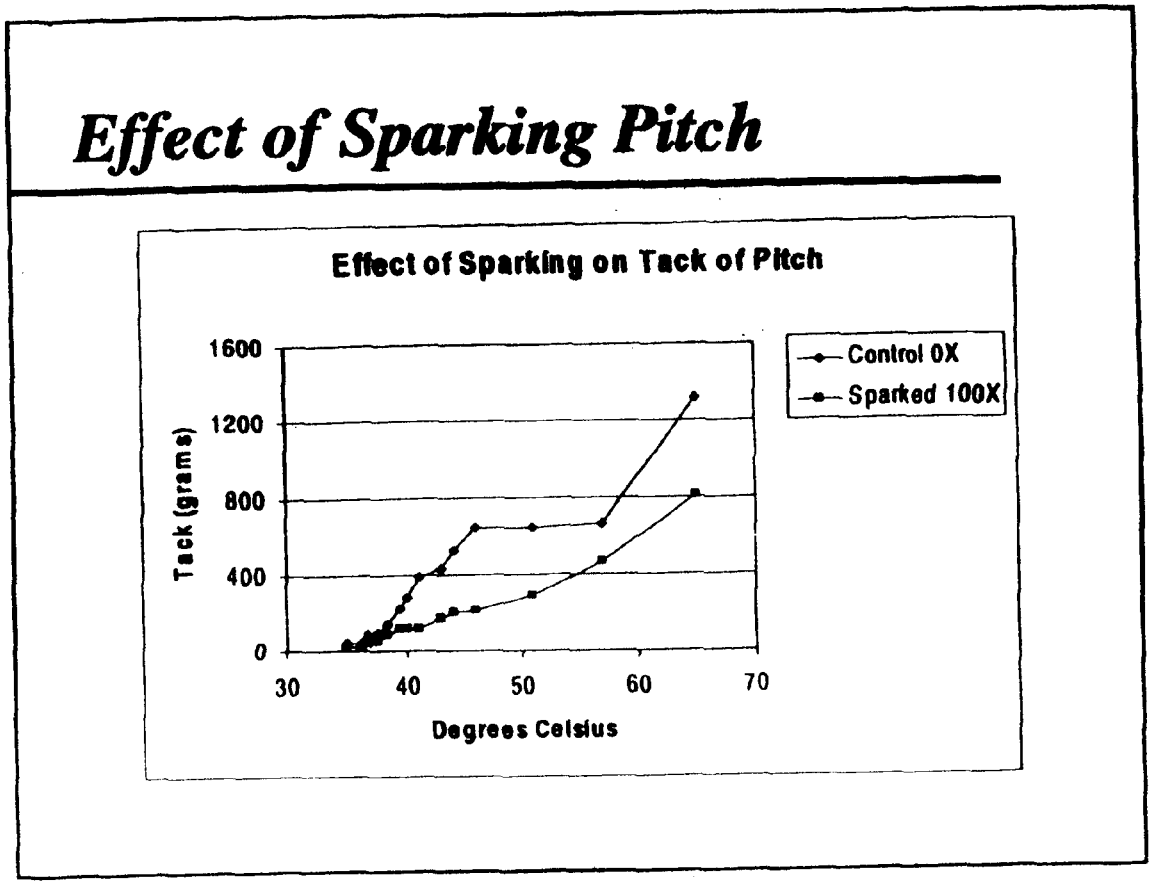
FIG. 7 is a graph illustrating the effect of sparking on tack of pitch in accordance with an embodiment of the present invention.

FIG. 7 is a graph illustrating the effect of sparking on pitch. Pitch films on metal coupons were heated to 100° C. and tested for tack using the Polyken Tack Tester manufactured and sold by Testing Machines Inc., Islandia, N.Y. Tack measurements were taken starting at 65° C. and ending at 35° C. The results show that tack was reduced for the pitch samples that were sparked 100 times compared to the control, which was not sparked.

The Spark-Generated Acoustic Field Effect

As previously mentioned, a spark creates a plasma channel between the electrode gap. The energy released upon collapse of the channel is dissipated as heat, as light, and through an acoustic field of sufficient intensity to generate hydroxyl radicals from water or components dissolved therein.

The following additional examples, which are illustrative of the present invention, further demonstrate additional applications of the present invention, as well as demonstrate the benefits associated therewith.

EXAMPLE 9

Exposing a contaminant, such as coated acrylate coupons, to sparks increases wettability and decreases tack, as shown in Table 2 herein below. The changes are insensitive to the distance of the material from the source and to whether the material faces toward or away from the spark.

TABLE 2

Tack Reduction of Acrylates through Exposure to 5000-V Sparks

| | no. of sparks | distance from source (cm) | contact angle degrees | tack (g/cm$^2$) |
|---|---|---|---|---|
| | | 130-L tank | | |
| control | 0 | | 91 | 1,350 |
| facing source | 30 | 50 | 81 | |
| away from source | 30 | 50 | 76 | 663 |
| close to source | 30 | 10 | 78 | 609 |
| close to source | 60 | 10 | 83 | 860 |

TABLE 2-continued

Tack Reduction of Acrylates through Exposure to 5000-V Sparks

| | no. of sparks | distance from source (cm) | contact angle degrees | tack (g/cm$^2$) |
|---|---|---|---|---|
| | | 10-L tank | | |
| facing source | 10 | 50 | 75 | 823 |
| facing source | 30 | 50 | 78 | 640 |
| facing source | 60 | 50 | 78 | 690 |

EXAMPLE 10

Figure 8:
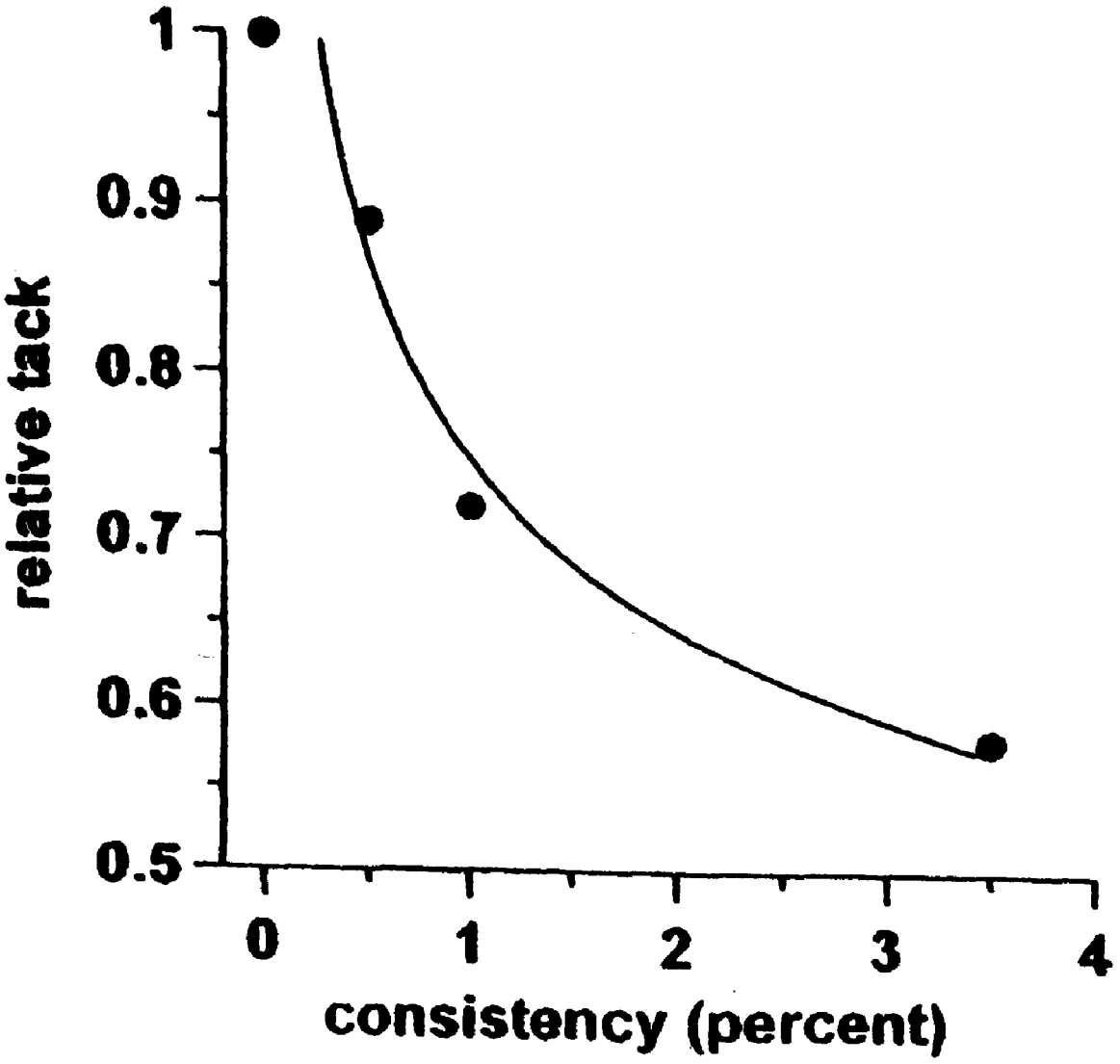
FIG. 8 is a graph illustrating the effect of pulp consistency on detackification.
Figure 9:
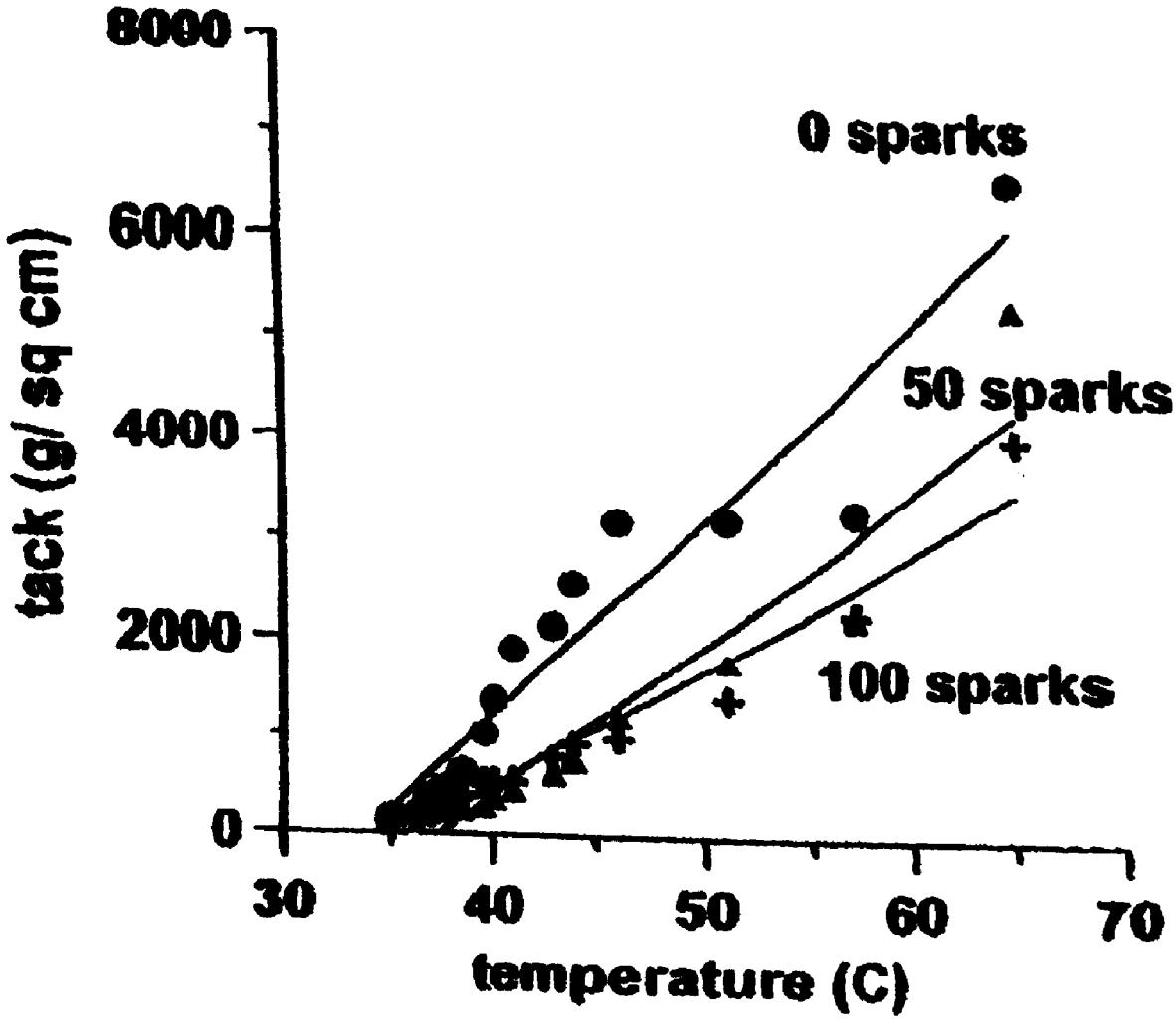
FIG. 9 is a graph illustrating the effect of sparking on the tackiness of pitch.

Results from tests made in the bleached softwood Kraft pulp suspensions of various consistencies (solids content) are illustrated in FIG. 8, and they show that the degree of detackification decreases progressively with increasing solids. This range of solids corresponds to that typically found in mill process streams, and despite the reduction in efficiency, substantial detackification still occurs at high consistency. Experiments conducted with the polymer film prepared on blotting paper show similar changes in contact angle, demonstrating that a hard support is not essential for detackification.

EXAMPLE 11

The changes in surface chemistry that accompany tack reduction were measured by X-ray photoelectron spectroscopy. The polymers listed in the following Table 3 were plated on metal coupons and exposed to forty 5000-V sparks; the surface O:C ratio increased in each case. Chlorine was detected at a level of 0.29% for the experiment run in the presence of sodium hypochlorite; no chlorine was found for the other cases. These measurements suggest a radical mechanism, with the source of oxygen being the hydroxyl radical.

TABLE 3

Surface Analysis of Polymers

| | | O:C ratio[a] |
|---|---|---|
| Polyacrylate | control | 0.28 |
| Polyacrylate | control | 0.28 |
| Polyacrylate | 40 sparks | 0.32 |
| Polyacrylate | 40 sparks in water containing 500 Ppm NaOCl | 0.30 |
| Polyvinyl acetate | control | 0.35 |
| Polyvinyl acetate | 40 sparks | 0.42 |

[a]The measurement uncertainty is 0.01.

EXAMPLE 12

To demonstrate that hydroxyl radicals are generated from sparking, the oxidation of 0.9 mM $Fe^{2+}$ was monitored in the presence of various amounts of sodium acetate, whose known oxidation rate with hydroxyl radicals was used as a reference. This simpler combination was used in place of the probe compounds in the following Table 4 in order to avoid complications from potential photochemical reactions. Each mixture was exposed to one hundred 5000-V sparks in a 10-L tank, and the $Fe^{2+} \rightarrow Fe^{3+}$ oxidation was followed at 350 nm. A rate constant of $4.9\times10^8$ L mol$^{-1}$ s$^{-1}$ was obtained for $Fe^{2+}$ oxidation, which compares well with the reported range of $(3.2–4.3)\times10^8$ L mol$^{-1}$ s$^{-1}$ for the oxidation of $Fe^2$ with hydroxyl radicals.

TABLE 4

Hydroxyl Radical Oxidation of Reference Compounds

| | k × $10^{-9}$ (L mol$^{-1}$ s$^{-1}$) measured | k × $10^{-9}$ (L mol$^{-1}$ s$^{-1}$) literature |
|---|---|---|
| sodium formate | 4.8 | 3.2 |
| thymine | 2.1 | 6.4 |
| sodium acetate | 0.9 | 0.85 |
| sodium thiocyanate | 10 | 11 |

The hydroxyl radical yield from sparking was measured by sparking 10 L of a Fricke dosimeter at a rate of 1 spark per second. Samples were drawn periodically, and the $Fe^{2+}$ to $Fe^{3+}$ oxidation was determined. The number of hydroxyl radicals was estimated as 25% of the total number of oxidized iron atoms. A value of $4\times10^{16}$/mL per spark was calculated after 4 minutes of sparking, assuming a linear dose-response relationship. The $FeSO_4$ was directly exposed to the sparks. No change occurs when the solution is contained in a quartz tube submerged in the tank and exposed to the sparks, confirming that it is the acoustic field and not the light that causes the oxidation.

The degree of oxidation is relatively insensitive to the applied voltage. Similar increases in absorbance were observed when a 0.1 mM $FeSO_4$ solution was exposed to sparks at charging voltages of 2000 and 6500 V. Experiments with ferrous sulfate conducted in a 4000-L tank showed that similar levels of oxidation were achieved at distances of 10 cm and 4.5 m from the source of the discharge. The ultraviolet light released from the discharge would be substantially absorbed by water and not be able to reach a distance of 4.5 meters from the source. This is consistent with the oxidizing species being generated by the propagating acoustic wave and not just in the plasma region. If light were responsible as taught in the prior art, then very little oxidation would have occurred, which is not the case in the present invention.

EXAMPLE 13

Figure 10:
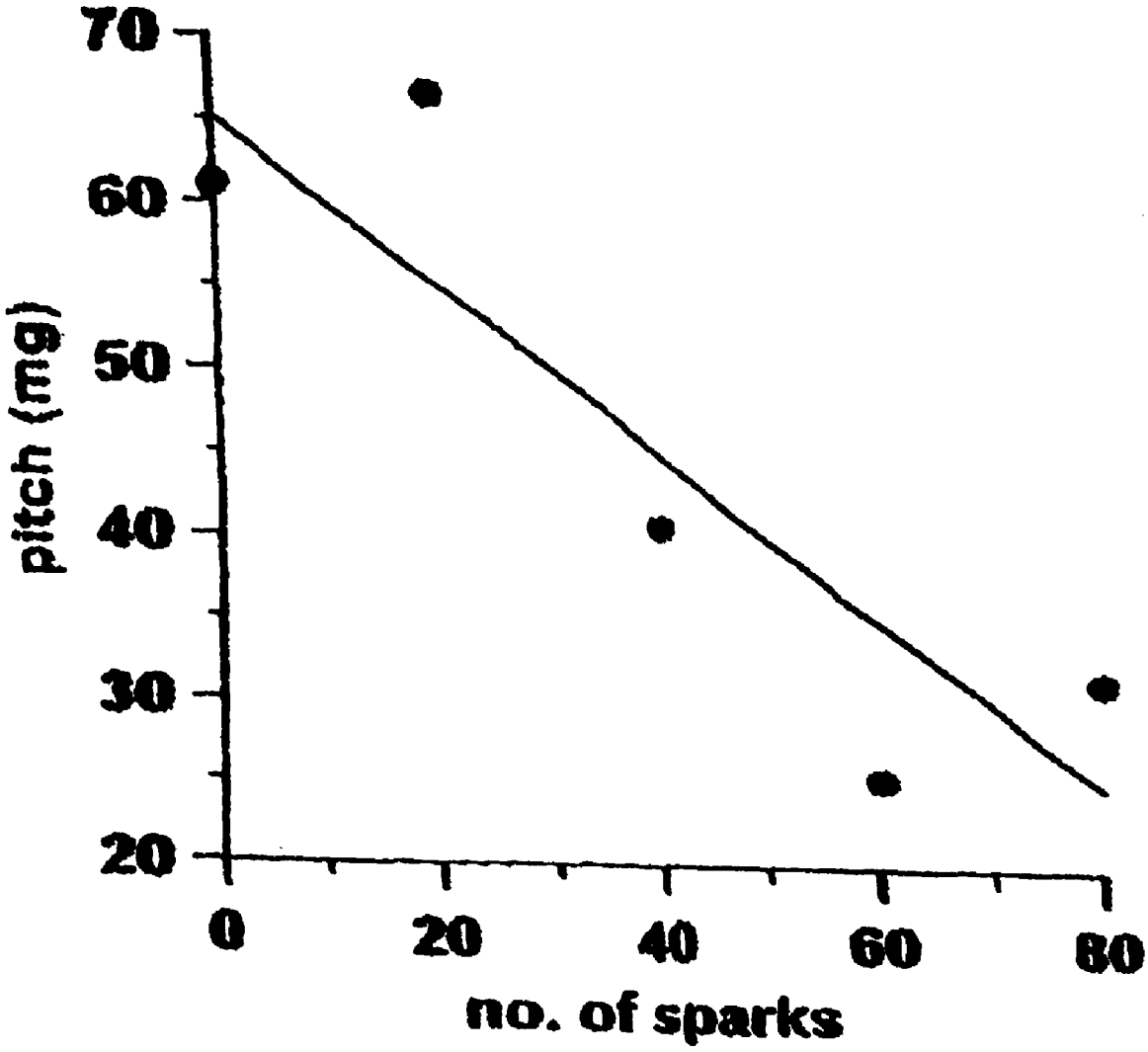
FIG. 10 illustrates the effect of sparking on pitch deposition.

Coupons coated with pitch (wood extractives) were exposed at room temperature to up to 100 sparks in the 10-L tank. Tack was measured at several temperatures as pitch is not tacky under ambient conditions. The results, illustrated in FIG. 9, demonstrate a substantial reduction in tack, especially at the higher temperatures. Sparking reduces the extent of pitch deposition, as illustrated in FIG. 10.

It can be shown that placement of the materials in an acoustic field leads to oxidative changes that are very similar to those measured during exposure to an electrohydraulic discharge as in the present invention. However, the acoustic field generated in sonochemistry heats up the water containing the materials, whereas the present invention does not heat the water. This difference makes the present inventive method more efficient in inducing oxidation, especially in industrial processes where large volumes of water are involved.

EXAMPLE 14

Figure 11A:
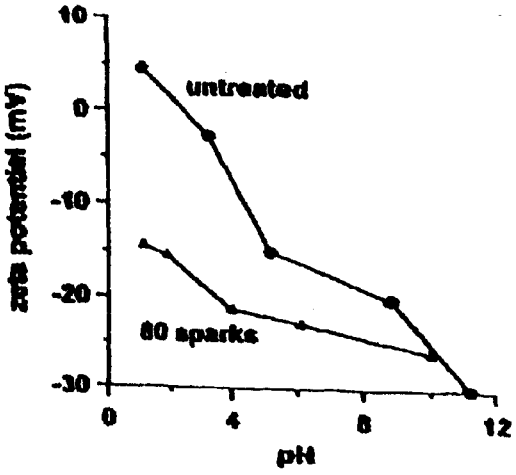
FIGS. 11*a* and 11*b* illustrate zeta potentials of carbotac and pitch vs. pH.
Figure 11B:
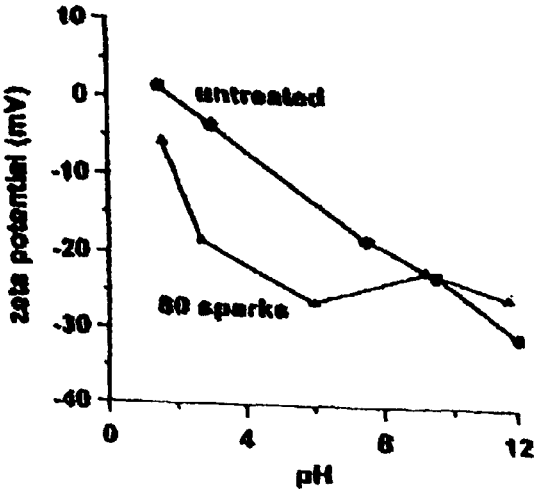
Figures 12A, 12B:
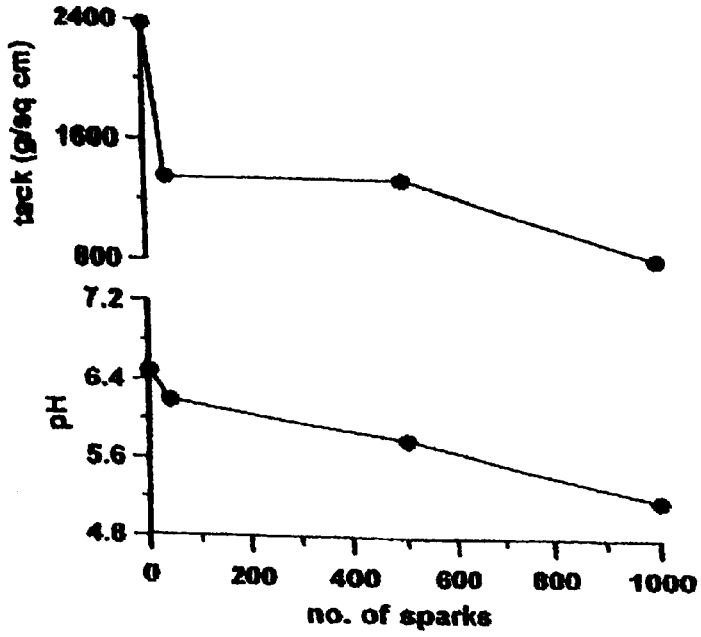
FIGS. 12*a* and 12*b* illustrate the tack and pH of sparked carbotac films.

Changes in the zeta potential of acrylate and pitch particles (up to 0–100$\mu$) induced by sparking are illustrated in FIGS. 11*a* and 11*b*. The plot for the untreated acrylate is typical of a nonpolar polymer surface. Sparking shifts the isoelectric point to lower pH, indicating the formation of acidic groups at the surface. This was confirmed by measuring the surface pH of an acrylate film coated on a metal coupon as a function of the number of sparks. The results, depicted in FIGS. 12*a* and 12*b*, show that sparking reduces both tack and pH.

Exposure of polymer surfaces to underwater sparks leads to their oxidation, namely through hydroxyl radicals generated by the acoustic field. A unique attribute of the present invention is that it efficiently generates hydroxyl radicals throughout a large volume, which makes it suitable for industrial applications.

Effect of Sparking on the Zeta Potential of Toner and Ink

The following additional examples, which are illustrative of the present invention, further demonstrate additional applications of the present invention, as well as demonstrate the benefits associated therewith.

EXAMPLE 15

Laser printer toner was cured at 400° C. for 30 seconds. The fused toner (0.63 g) was ground to a fine powder and suspended in 7.2 L of deionized water. The pH was adjusted to 6.6 with 50% NaOH. The suspension was subjected to sparking (4 kV) and samples were collected after 0, 25, 50, 100, 200, 300 and 400 sparks. The results, shown in Table 5, demonstrate that pH and zeta potential decrease upon sparking.

TABLE 5

Effect of sparking on toner.

| no. of sparks | pH | zeta potential (mV) |
|---|---|---|
| 0 | 6.6 | −3.8 |
| 25 | 6.4 | −15.4 |
| 50 | 5.9 | −16.0 |
| 100 | 5.1 | −17.9 |
| 200 | 4.9 | −19.6 |
| 300 | 4.8 | −23.8 |
| 400 | 4.6 | −21.6 |

EXAMPLE 16

A similar experiment was performed with flexographic ink obtained from a newspaper. A small quantity (0.34 g) of the ink paste was dispersed in 1% NaOH for 3 hours at 60° C. The dispersed ink was added to 7 L of DI water, the pH was adjusted to 6.0 with 20% $H_2SO_4$, and the suspension was sparked. The results, shown in Table 6, are similar to those in Table 5, in that sparking reduces both pH and zeta potential.

TABLE 6

Effect of sparking on newsprint ink

| no. of sparks | pH | zeta potential (mV) |
|---|---|---|
| 0 | 6.0 | −32 |
| 25 | 5.94 | −36 |
| 50 | 5.90 | −36 |
| 100 | 5.82 | −39 |
| 200 | 5.63 | −39 |
| 300 | 5.45 | −40 |
| 400 | 5.26 | −41 |

Figure 13:
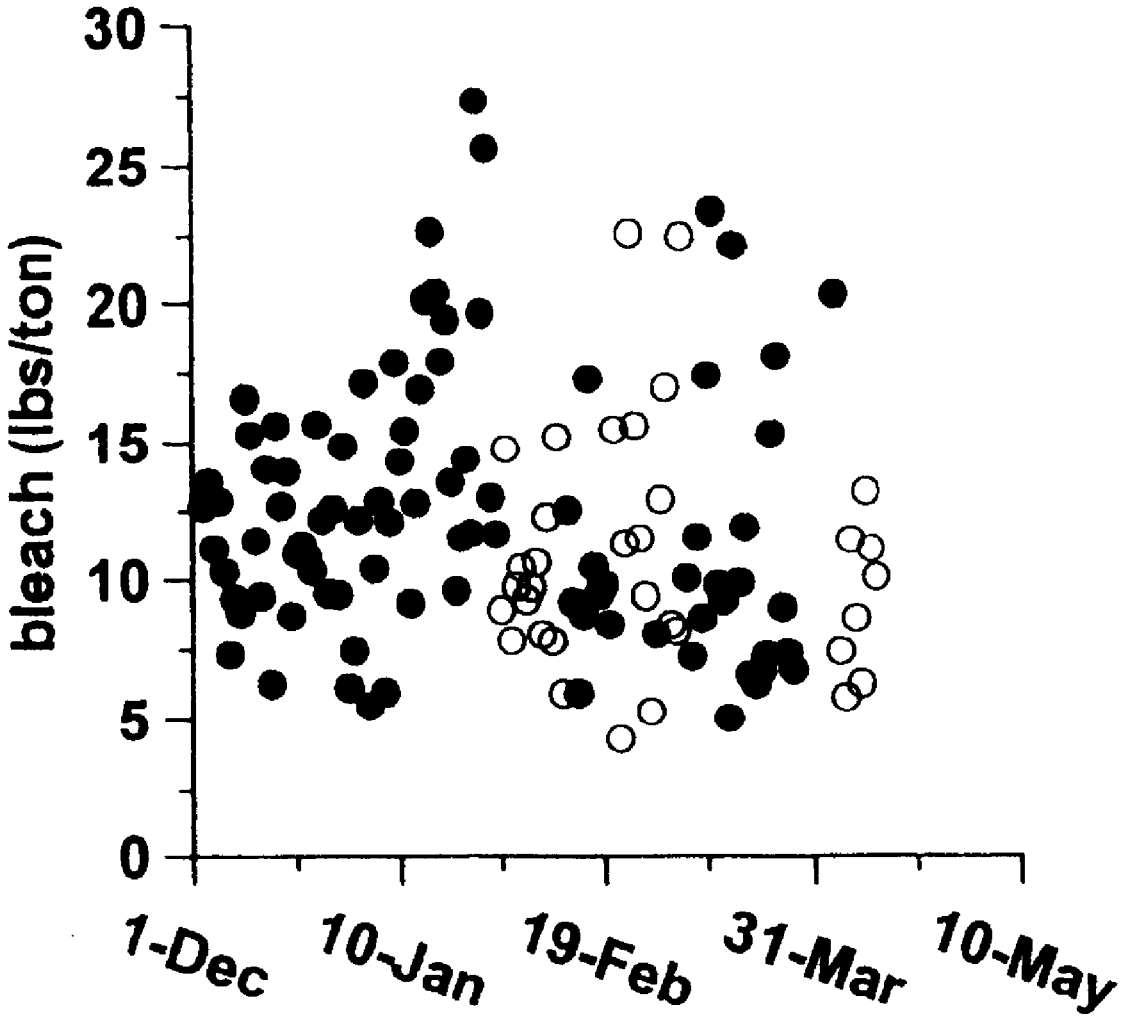
FIG. 13 is a graph illustrating the results of bleach use in a commercial deinking facility.

The reduction of both pH and zeta potential is due to the oxidation of the ink particles. The finding is important in the recycled newsprint industry where ink reattachment to fiber darkens the pulp and leads to increased bleach use to offset the darkening. The lowered zeta potential due to exposure to the sparking device makes the ink particle more negative, and increases the repulsion of the negative ink particle to the negative fiber. A full-scale illustration of this effect is evident in FIG. 13, which shows the effect of sparking on bleach use in a commercial deinking mill. In FIG. 13, the closed circles are with the sparker off, and the open circles are with the sparker on. The median bleach used with the sparker off is 11.5 lbs/ton; with the sparker on, the value falls to 10.1 lbs/ton.

The decreased bleach use is a direct consequence of exposure to the sparking device. The difference in bleach use represents an appreciable cost savings. The sparking device was placed in the 500,000 liter chest just after the repulper. The water in the chest has a residence time of 40 minutes, so sparking affects at least 12,500 liters per minute. The spark rate was 12 sparks per minute, and it has been shown that about 30 sparks are needed to effect oxidation of a particle. Hence, a volume of about 30,000 liters is affected by the sparking device. If this volume occupies a sphere, then the effect of a spark is at least 2 meters from the source. This large range effect of the sparker provides benefit in that the sparking device can be used to oxidatively treat large volumes of process water.

EXAMPLE 17

Figure 14:
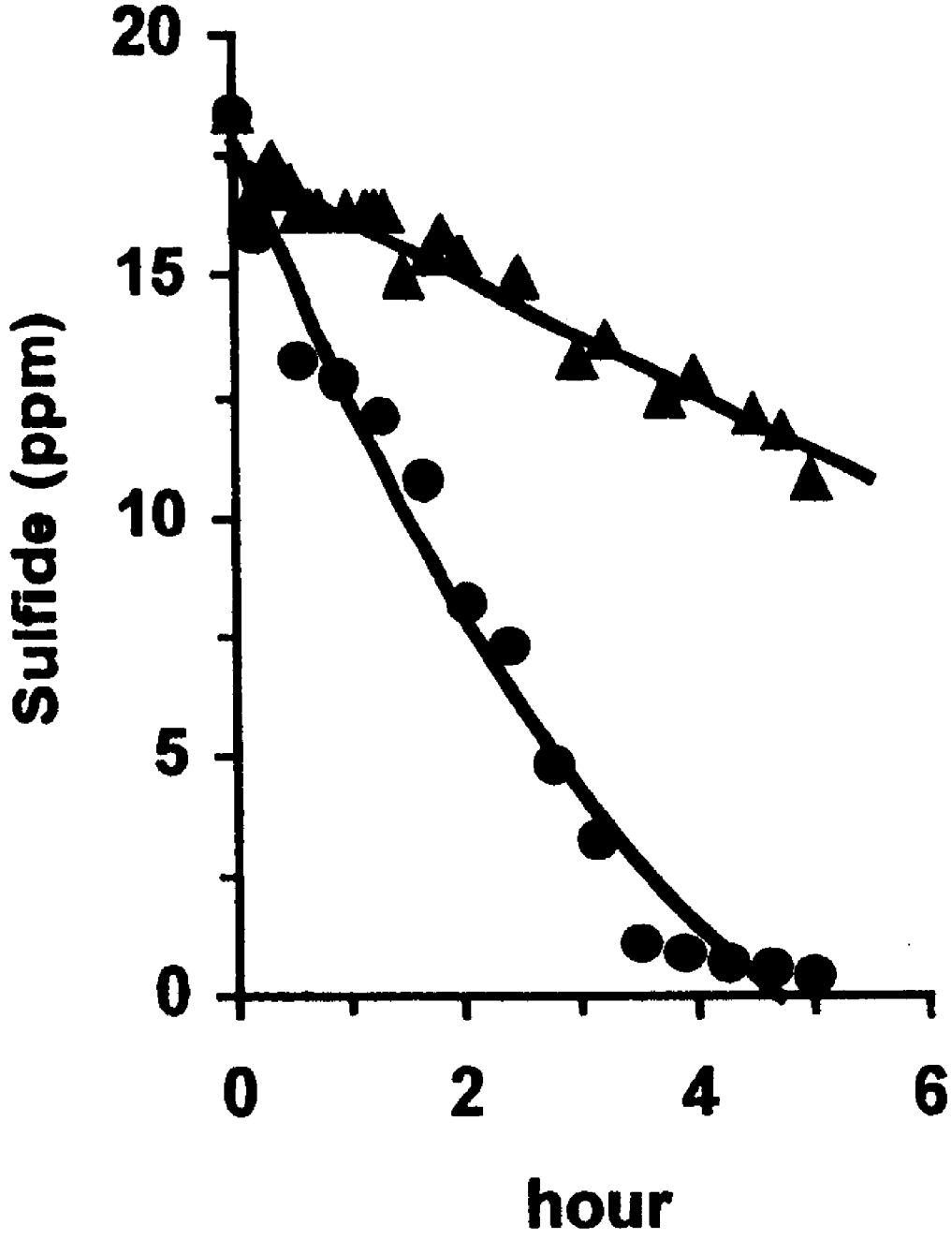
FIG. 14 is a graph illustrating the results of sulfide oxidized in an open container in accordance with the present invention.

In another useful application, sulfide, an odorous component in water is removed upon exposure to the sparking device. The results of one such experiment is illustrated in FIG. 14. In FIG. 14, the sulfide is oxidized in an open container. In FIG. 14, the triangles represent the control, and the circles represent the results upon exposure to sparks at a rate of 2 sparks per-minute.

EXAMPLE 18

A sparker device was placed in the whitewater system of a paper mill that processed old corrugated containers. The volume of the whitewater was about five million gallons. Build-up of tacky adhesive material occurred on the felts used to dry the paper that was formed from the fiber contained in the whitewater. The Sparker was able to reduce the tack of the deposits to the point where it could be washed off with a high-pressure hose. Typically, the deposits would need to scraped off without application of the present invention. It would be impractical to treat this large volume with an acoustic field, such as used in sonochemistry, due to the high capital costs and the amount of heat needed to be added to the water.

Advantageously, the present invention is an inexpensive system and method for altering the surface energy of materials. The inventive system is simple to implement and provides an economic benefit of reducing the tack of materials without using chemicals, which can be very expensive. However, the inventive system may be used in conjunction with use of conventional chemicals to further improve detackification, while reducing the amount of chemicals typically required for such purposes.

In addition, the present invention provides the benefit of oxidizing materials contained in water or fibrous stream over a long range, such that the effects include odor reduction, reduction of zeta potential and pH of ink and toner, as well as other important effects as demonstrated in the foregoing examples.

Alternative embodiments will become apparent to those skilled in the art to which the present invention pertains without departing from its spirit and scope. Accordingly, the scope of the present invention is defined by the appended claims rather than the foregoing description.

What is claimed is:

1. A method for oxidizing a material in a fiber stream, comprising the steps of:

providing a fiber stream; and causing oxidation of a material in the fiber stream by producing a predetermined amount of electrical discharge in the fiber stream.

2. The method of claim 1, wherein causing oxidation of the material in the fiber stream reduces the zeta potential of the material in the fiber stream.

3. The method of claim 1, wherein causing oxidation of the material in the fiber stream reduces the tack of the material.

4. The method of claim 1, wherein the material is ink.

5. The method of claim 4, wherein the ink is on a fiber in the fiber stream.

6. The method of claim 4, wherein oxidizing the ink reduces the ability of the ink to adhere to a fiber in the fiber stream.

7. The method of claim 1, wherein the material is toner.

8. The method of claim 7, wherein the toner is on a fiber in the fiber stream.

9. The method of claim 7, wherein oxidizing the toner reduces the ability of the toner to adhere to a fiber in the fiber stream.

10. The method of claim 1, wherein the material is a sulfide.

11. The method of claim 10, wherein oxidizing the sulfide reduces the odor of the fiber stream.

12. The method of claim 1, wherein the material is a polymer used as an adhesive.

13. The method of claim 12, wherein oxidizing the polymer reduces tack.

14. The method of claim 1, wherein the material is pitch.

15. The method of claim 14, wherein oxidizing the pitch reduces tack.

16. A method for oxidizing a material in a liquid medium, comprising the steps of:

providing a liquid medium;

providing a material in the liquid medium; and introducing a predetermined amount of electrical discharge in the liquid medium to cause oxidation of the material, said oxidation occurring independent of a light source.

17. The method of claim 16, wherein the electrical discharge in the liquid medium occurs periodically.

18. The method of claim 16, wherein the liquid medium is selected from a group consisting of whitewater, water, and a pulp slurry.

19. The method of claim 16, wherein the oxidation of the material reduces the zeta potential of the material in the liquid medium.

20. The method of claim 16, wherein the oxidation of the material reduces the tack of the material.

21. The method of claim 16, wherein the oxidation of the material reduces the odor of the liquid medium.

22. The method of claim 16, wherein the material is an adhesive.

23. The method of claim 16, wherein the material is pitch.

24. The method of claim 16, wherein the material is ink.

25. The method of claim 16, wherein the material is toner.

26. The method of claim 16, wherein the material is a sulfide.

27. A method for oxidizing a material in a liquid medium, comprising the steps of:

providing a liquid medium containing a material; and introducing a predetermined amount of electrical discharge from a discharge source in the liquid medium to cause oxidation of the material at a predetermined distance in the liquid medium from the discharge source, where light emitted from the discharge source is negligible.

28. The method of claim 27, wherein the predetermined distance is beyond 8 cm from the discharge source.

29. The method of claim 27, wherein the predetermined distance ranges from about 10 cm to about 4.5 m from the discharge source.

30. The method of claim 27, wherein the liquid medium is selected from a group consisting of whitewater, water, and a pulp slurry.

31. The method of claim 27, wherein the oxidation of the material reduces the zeta potential of the material in the liquid medium.

32. The method of claim 27, wherein the oxidation of the material reduces the tack of the material.

33. The method of claim 27, wherein the oxidation of the material reduces the odor of the liquid medium.

34. The method of claim 27, wherein the material is an adhesive.

35. The method of claim 27, wherein the material is pitch.

36. The method of claim 27, wherein the material is ink.

37. The method of claim 27, wherein the material is toner.

38. The method of claim 27, wherein the material is a sulfide.

39. The method of claim 27, wherein the electrical discharge in the liquid medium occurs periodically.

* * * * *